US009164414B2

(12) United States Patent
Murakami et al.

(10) Patent No.: US 9,164,414 B2
(45) Date of Patent: Oct. 20, 2015

(54) OPTICAL WRITING CONTROL DEVICE, IMAGE FORMING APPARATUS, AND METHOD OF CONTROLLING OPTICAL WRITING DEVICE

(71) Applicants: Masatoshi Murakami, Osaka (JP); Tatsuya Miyadera, Kanagawa (JP); Masayuki Hayashi, Osaka (JP); Yoshinori Shirasaki, Osaka (JP); Motohiro Kawanabe, Osaka (JP)

(72) Inventors: Masatoshi Murakami, Osaka (JP); Tatsuya Miyadera, Kanagawa (JP); Masayuki Hayashi, Osaka (JP); Yoshinori Shirasaki, Osaka (JP); Motohiro Kawanabe, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/093,846

(22) Filed: Dec. 2, 2013

(65) Prior Publication Data

US 2014/0152754 A1 Jun. 5, 2014

(30) Foreign Application Priority Data

Dec. 3, 2012 (JP) ..... 2012-264469

(51) Int. Cl.

| | |
|---|---|
| ***B41J 2/385*** | (2006.01) |
| ***B41J 2/435*** | (2006.01) |
| ***G03G 15/043*** | (2006.01) |
| ***G03G 15/00*** | (2006.01) |

(52) U.S. Cl.

CPC ..... *G03G 15/043* (2013.01); *G03G 15/5058* (2013.01); *G03G 2215/0161* (2013.01)

(58) Field of Classification Search

USPC ..... 347/116, 229, 234, 248; 399/40, 72

See application file for complete search history.

(56) References Cited

U.S. PATENT DOCUMENTS

| | | | | |
|---|---|---|---|---|
| 6,429,886 | B2 * | 8/2002 | Ohki | 347/115 |
| 7,623,143 | B2 * | 11/2009 | Kitao | 347/116 |
| 7,986,907 | B2 * | 7/2011 | Miyadera | 399/301 |
| 8,369,724 | B2 * | 2/2013 | Murayama | 399/49 |
| 2004/0070714 | A1 | 4/2004 | Ishii et al. | |
| 2008/0038024 | A1 | 2/2008 | Miyadera | |
| 2008/0069602 | A1 | 3/2008 | Miyadera | |
| 2008/0170868 | A1 | 7/2008 | Miyadera | |
| 2008/0212986 | A1 | 9/2008 | Miyadera | |
| 2008/0240797 | A1 * | 10/2008 | Ohmiya et al. | 399/301 |
| 2009/0074476 | A1 | 3/2009 | Miyadera | |
| 2009/0161142 | A1 | 6/2009 | Miyadera et al. | |

(Continued)

FOREIGN PATENT DOCUMENTS

| | | |
|---|---|---|
| JP | 2001-142267 | 5/2001 |
| JP | 2004-069767 | 3/2004 |

(Continued)

*Primary Examiner* — Hai C Pham

(74) *Attorney, Agent, or Firm* — Harness, Dickey & Pierce

(57) ABSTRACT

An optical writing control device includes a light emission control unit that controls light emission of a light source to exposes a photosensitive element. The light emission control unit is configured to draw two patterns as patterns for correction used to correct a transfer position of a developer image obtained by developing an electrostatic latent image formed on the photosensitive element, the two patterns including a narrow width pattern where a width of the pattern corresponds to a width of a detection area of a sensor that detects the patterns, in the main-scanning direction, and a wide width pattern having a wider width than the narrow width pattern, and control the light emission, after calculation of a correction value based on a detection signal of the wide width pattern is properly completed, in a manner where the narrow width pattern is drawn upon the calculation of the correction value.

12 Claims, 10 Drawing Sheets

(56) References Cited

U.S. PATENT DOCUMENTS

| | | | | |
|---|---|---|---|---|
| 2009/0185816 | A1 | 7/2009 | Miyadera | |
| 2009/0190940 | A1 | 7/2009 | Miyadera | |
| 2009/0196636 | A1 | 8/2009 | Miyadera | |
| 2009/0220878 | A1 | 9/2009 | Miyadera et al. | |
| 2010/0232817 | A1 | 9/2010 | Miyadera et al. | |
| 2010/0239331 | A1 | 9/2010 | Miyadera et al. | |
| 2011/0026082 | A1 | 2/2011 | Miyadera et al. | |
| 2011/0158670 | A1* | 6/2011 | Fuchimoto | 399/66 |
| 2011/0228364 | A1 | 9/2011 | Miyadera et al. | |
| 2011/0229172 | A1 | 9/2011 | Miyadera et al. | |
| 2012/0224191 | A1* | 9/2012 | Abe | 358/1.5 |

FOREIGN PATENT DOCUMENTS

| | | |
|---|---|---|
| JP | 2005-165049 | 6/2005 |
| JP | 2009-069767 | 4/2009 |

* cited by examiner

FIG.9

| TIMING | EVENT | MARK FOR MISALIGNMENT CORRECTION |
|---|---|---|
| TURNING ON OF POWER | DETECTION OF REPLACEMENT OF Bk PHOTOSENSITIVE ELEMENT UNIT | FIRST MARK FOR MISALIGNMENT CORRECTION |
| | DETECTION OF REPLACEMENT OF C, M AND Y PHOTOSENSITIVE ELEMENT UNITS | FIRST MARK FOR MISALIGNMENT CORRECTION |
| | DETECTION OF REPLACEMENT OF INTERMEDIATE TRANSFER UNIT | FIRST MARK FOR MISALIGNMENT CORRECTION |
| WRITE DETECTION, RETURN FROM SLEEP MODE | DETECTION OF REPLACEMENT OF Bk PHOTOSENSITIVE ELEMENT UNIT | FIRST MARK FOR MISALIGNMENT CORRECTION |
| | DETECTION OF REPLACEMENT OF C, M AND Y PHOTOSENSITIVE ELEMENT UNITS | FIRST MARK FOR MISALIGNMENT CORRECTION |
| | DETECTION OF REPLACEMENT OF INTERMEDIATE TRANSFER UNIT | FIRST MARK FOR MISALIGNMENT CORRECTION |
| OPENING/CLOSING OF COVER | DETECTION OF REPLACEMENT OF Bk PHOTOSENSITIVE ELEMENT UNIT | |
| | DETECTION OF REPLACEMENT OF C, M AND Y PHOTOSENSITIVE ELEMENT UNITS | FIRST MARK FOR MISALIGNMENT CORRECTION |
| | DETECTION OF REPLACEMENT OF INTERMEDIATE TRANSFER UNIT | FIRST MARK FOR MISALIGNMENT CORRECTION |
| END OF MISALIGNMENT CORRECTION IN NORMAL MODE | SUCCESS IN MISALIGNMENT CORRECTION | SECOND MARK FOR MISALIGNMENT CORRECTION |
| | FAILURE IN MISALIGNMENT CORRECTION | FIRST MARK FOR MISALIGNMENT CORRECTION |
| END OF MISALIGNMENT CORRECTION IN PROCESS MODE | SUCCESS IN MISALIGNMENT CORRECTION | FIRST MARK FOR MISALIGNMENT CORRECTION |
| | FAILURE IN MISALIGNMENT CORRECTION | FIRST MARK FOR MISALIGNMENT CORRECTION |
| END OF MISALIGNMENT CORRECTION IN MONOCHROME MODE | SUCCESS IN MISALIGNMENT CORRECTION | FIRST MARK FOR MISALIGNMENT CORRECTION |
| | FAILURE IN MISALIGNMENT CORRECTION | FIRST MARK FOR MISALIGNMENT CORRECTION |
| ... | | |

OPTICAL WRITING CONTROL DEVICE, IMAGE FORMING APPARATUS, AND METHOD OF CONTROLLING OPTICAL WRITING DEVICE

CROSS-REFERENCE TO RELATED APPLICATIONS

The present application claims priority to and incorporates by reference the entire contents of Japanese Patent Application No. 2012-264469 filed in Japan on Dec. 3, 2012.

BACKGROUND OF THE INVENTION

1. Field of the Invention

The embodiment disclosed herein relates to an optical writing control device, an image forming apparatus, and a method of controlling an optical writing device, and especially relates to a configuration of a pattern drawn to correct the drawing position of an image.

2. Description of the Related Art

In recent years, there has been a trend to promote the digitization of information. Image processing apparatuses such as printers and facsimiles that are used to output digitized information and scanners used to digitize documents have become indispensable apparatuses. In many cases, such an image processing apparatus is configured as a multifunction peripheral that can be used as a printer, a facsimile, a scanner, and a copying machine by including an image capture function, an image forming function, a communication function, and the like.

Among such image processing apparatuses, an electrophotographic image forming apparatus is widely used as an image forming apparatus used to output digitized documents. The electrophotographic image forming apparatus exposes a photosensitive element to form an electrostatic latent image, develops the electrostatic latent image with developer such as toner to form a toner image, and transfer the toner image onto a piece of paper to output the paper.

Such an electrophotographic image forming apparatus synchronizes the timing to expose the photosensitive element and draw an electrostatic latent image with the timing to convey the paper and accordingly makes adjustments so as to form an image within a proper area on the paper. Moreover, a tandem image forming apparatus that forms a color image with a plurality of photosensitive elements adjusts exposure timing at the photosensitive element of each color so as to accurately overlap images developed at the photosensitive elements of the respective colors. Hereinafter, these adjustment processes are collectively referred to as the misalignment correction.

Specific methods for realizing such misalignment correction as have been described above include a mechanical adjustment method for adjusting an arrangement relationship between a light source to expose the photosensitive element and the photosensitive element, and a method by image processing that adjusts an image to be output in accordance with misalignment to eventually form the image at a suitable position. In a case of the method by image processing, it is configured such that a pattern for correction is drawn and read and accordingly a correction is mage based on a difference between the timing determined in terms of design and the timing at which the pattern is actually read and an image is formed at a desired position.

Moreover, a technology for improving the accuracy of reading by a sensor that reads the pattern for correction is proposed for the method by image processing (see, for example, Japanese Laid-open Patent Publication No. 2004-069767). In Japanese Laid-open Patent Publication No. 2004-069767, after a correction is made based on a pattern for correction drawn with a margin for an area of reading by a reading sensor, in other words, a pattern for correction drawn larger to avoid any trouble with reading even if misalignment is occurring, a pattern for correction drawn in a size corresponding to the area of reading by the reading sensor is drawn to perform the correction process again. Consequently, in the second correction process to be executed, the influence of diffuse reflection light from an extra drawn part can be excluded and the highly accurate correction process becomes possible.

In a case of the technology disclosed in Japanese Laid-open Patent Publication No. 2004-069767, if misalignment is caused between the time when a correction is made based on the pattern for correction drawn with a margin for the area of reading by the reading sensor and the time when a correction is made based on the pattern for correction drawn in the size corresponding to the area of reading by the reading sensor, the pattern drawn in a state where the margin for the area of reading is small is not suitably read. As a consequence, a correction is not accurately made based on the pattern for correction drawn in the size corresponding to the area of reading by the reading sensor, and the accuracy of the operation of the apparatus is impaired.

In view of the above circumstances, there is a need to balance a reduction in the amount of toner consumption related to the drawing of the pattern for correction with the accuracy of the operation of the apparatus.

SUMMARY OF THE INVENTION

It is an object of the present invention to at least partially solve the problems in the conventional technology.

An optical writing control device controls a light source that exposes a photosensitive element and forms an electrostatic latent image on the photosensitive element. The optical writing control device includes: a light emission control unit that controls light emission of the light source based on information on pixels constituting an image to be formed and output, and exposes the photosensitive element; a detection signal acquisition unit that acquires a detection signal of a sensor that detects an image on a conveying path on which the image obtained by developing the electrostatic latent image formed on the photosensitive element is transferred and conveyed; and a correction value calculation unit that calculates, based on the detection signal when the sensor detects a pattern for correction used to correct a transfer position of a developer image obtained by developing the electrostatic latent image formed on the photosensitive element, a correction value used to correct the transfer position. The light emission control unit is configured to draw two patterns as the patterns for correction used to correct the transfer position, the two patterns including a narrow width pattern where a width of the pattern in a main-scanning direction corresponds to a width of a detection area of the sensor in the main-scanning direction, and a wide width pattern having a wider width than the width of the narrow width pattern in the main-scanning direction, and control the light emission of the light source, after calculation of the correction value based on the detection signal of the wide width pattern is properly completed, in a manner where the narrow width pattern is drawn upon the calculation of the correction value.

An image forming apparatus includes a optical writing control device that controls a light source that exposes a photosensitive element and forms an electrostatic latent image on the photosensitive element. The optical writing control device includes: a light emission control unit that controls light emission of the light source based on information on pixels constituting an image to be formed and output, and exposes the photosensitive element; a detection signal acquisition unit that acquires a detection signal of a sensor that detects an image on a conveying path on which the image obtained by developing the electrostatic latent image formed on the photosensitive element is transferred and conveyed; and a correction value calculation unit that calculates, based on the detection signal when the sensor detects a pattern for correction used to correct a transfer position of a developer image obtained by developing the electrostatic latent image formed on the photosensitive element, a correction value used to correct the transfer position. The light emission control unit is configured to draw two patterns as the patterns for correction used to correct the transfer position, the two patterns including a narrow width pattern where a width of the pattern in a main-scanning direction corresponds to a width of a detection area of the sensor in the main-scanning direction, and a wide width pattern having a wider width than the width of the narrow width pattern in the main-scanning direction, and control the light emission of the light source, after calculation of the correction value based on the detection signal of the wide width pattern is properly completed, in a manner where the narrow width pattern is drawn upon the calculation of the correction value.

A method controls an optical writing device that controls a light source that exposes a photosensitive element and forms an electrostatic latent image on the photosensitive element. The optical writing device includes: a light emission control unit that controls light emission of the light source based on information on pixels constituting an image to be formed and output, and exposes the photosensitive element, and a detection signal acquisition unit that acquires a detection signal of a sensor that detects an image on a conveying path on which the image obtained by developing the electrostatic latent image formed on the photosensitive element is transferred and conveyed. The method includes: controlling the light emission of the light source in a manner where, as a pattern for correction used to correct a transfer position of a developer image obtained by developing the electrostatic latent image formed on the photosensitive element, a wide width pattern with a wider width in a main-scanning direction than a narrow width pattern with a width in the main-scanning direction corresponding to a width of a detection area of the sensor in the main-scanning direction, calculating a correction value used to correct the transfer position, based on the detection signal when the wide width pattern is detected by the sensor, and controlling the light emission of the light source in a manner where the narrow width pattern is drawn upon the calculation of the correction value after calculation of the correction value based on the detection signal of the wide width pattern is properly completed.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 9 is a diagram illustrating switching conditions of the mark for misalignment correction according to the present invention;

DETAILED DESCRIPTION OF THE PREFERRED EMBODIMENTS

Hereinafter, an embodiment of the present invention will be described in detail with reference to the drawings. In the embodiment, a description will be given taking an image forming apparatus being a multifunction peripheral (MFP: Multi Function Peripheral) as an example. The image forming apparatus according to the embodiment is an electrophotographic image forming apparatus, includes two kinds of patterns used in a misalignment correction operation for correcting the timing of exposing a photosensitive element, and has a feature that the two kinds of patterns are used for different purposes.

Figure 1:
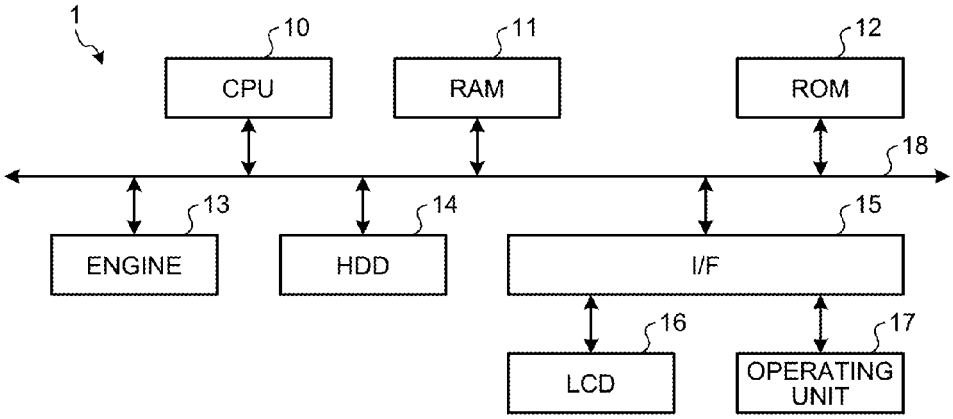
FIG. 1 is a block diagram illustrating a hardware configuration of an image forming apparatus according to an embodiment of the present invention.

FIG. 1 is a block diagram illustrating a hardware configuration of an image forming apparatus 1 according to the embodiment. As illustrated in FIG. 1, the image forming apparatus 1 according to the embodiment includes an engine that forms an image in addition to a similar configuration to an information processing terminal such as a general server or PC (Personal Computer). In other words, in the image forming apparatus 1 according to the embodiment, a CPU (Central Processing Unit) 10, a RAM (Random Access Memory) 11, a ROM (Read Only Memory) 12, an engine 13, an HDD (Hard Disk Drive) 14, and an I/F 15 are connected via a bus 18. Moreover, the I/F 15 is connected to an LCD (Liquid Crystal Display) 16 and an operating unit 17.

The CPU 10 is a computing unit and controls the operation of the entire image forming apparatus 1. The RAM 11 is a volatile storage medium that allows information to be read and written at high speeds, and is used as a work area when the CPU 10 processes information. The ROM 12 is a non-volatile storage medium for read only that stores programs of firmware and the like. The engine 13 is a mechanism to actually form an image in the image forming apparatus 1.

The HDD 14 is a non-volatile storage medium that allows information to be read and written, in which an OS (Operating System), and various control programs, application programs, and the like are stored. The I/F 15 connects the bus 18 to various types of hardware, networks, and the like and controls them. The LCD 16 is a visual user interface that allows a user to check the state of the image forming apparatus 1. The operating unit 17 is a user interface, such as a keyboard or mouse, that allows the user to input information into the image forming apparatus 1.

In such a hardware configuration, programs stored in recording media such as the ROM 12, and the HDD 14 or an unillustrated optical disc are read out to the RAM 11, and the CPU 10 performs computations in accordance with these programs to configure a software control unit. A combination of the software control unit configured in this manner and hardware constructs a functional block to realize the functions of the image forming apparatus 1 according to the embodiment.

Figure 2:
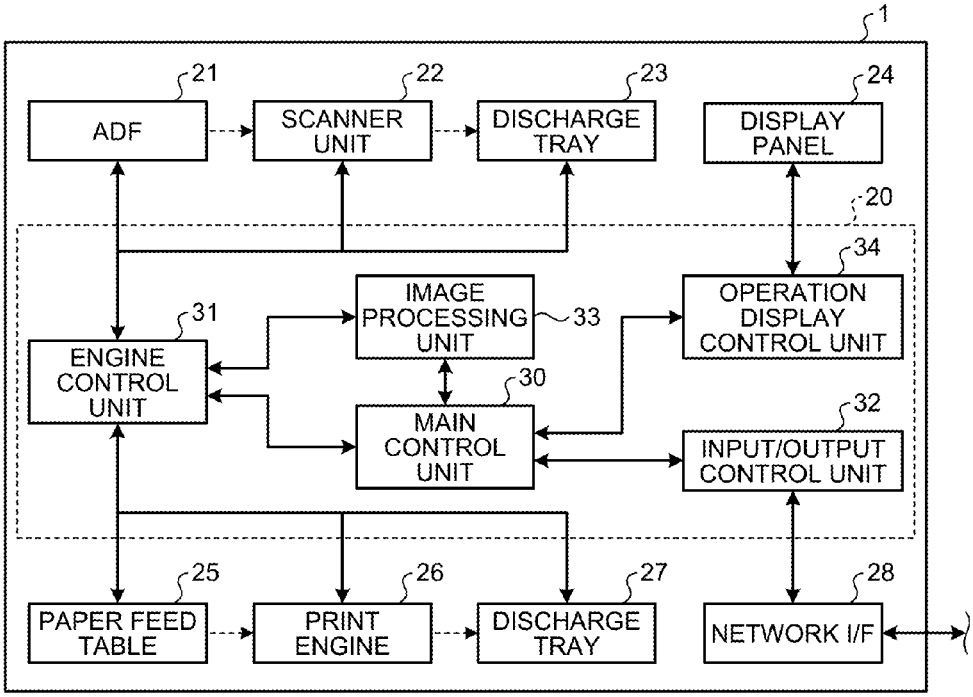
FIG. 2 is a diagram illustrating a functional configuration of the image forming apparatus according to the embodiment of the present invention.

Next, a functional configuration of the image forming apparatus 1 according to the embodiment will be described with reference to FIG. 2. FIG. 2 is a block diagram illustrating a functional configuration of the image forming apparatus 1 according to the embodiment. As illustrated in FIG. 2, the image forming apparatus 1 according to the embodiment includes a controller 20, an ADF (Auto Documennt Feeder: automatic document feeder) 110, a scanner unit 22, a discharge tray 23, a display panel 24, a paper feed table 25, a print engine 26, a discharge tray 27, and a network I/F 28.

Moreover, the controller 20 includes a main control unit 30, an engine control unit 31, an input/output control unit 32, an image processing unit 32, and an operation display control unit 34. As illustrated in FIG. 2, the image forming apparatus 1 according to the embodiment is configured as a multifunction peripheral having the scanner unit 22, and the print engine 26. In FIG. 2, electrical connections are illustrated by the arrows of the solid lines, and the flow of paper is illustrated by the broken lines.

The display panel 24 is an output interface to visually display the state of the image forming apparatus 1, and also an input interface (operating unit) when the user directly operates the image forming apparatus 1 or inputs information into the image forming apparatus 1 as a touchscreen. The network I/F 28 is an interface to allow the image forming apparatus 1 to communicate with another device via a network, and uses an Ethernet (registered trademark) or USB (Universal Serial Bus) interface.

The controller 20 is configured by combining software and hardware. Specifically, control programs of firmware and the like that are stored in the ROM 12 and a non-volatile memory, and non-volatile recording media such as the HDD 14 and an optical disc are loaded into a volatile memory (hereinafter, the memory) such as the RAM 11, and the controller 20 is configured of the software control unit configured by the computations of the CPU 10 in accordance with these programs, and hardware such as an integrated circuit. The controller 20 functions as a control unit for controlling the entire image forming apparatus 1.

The main control unit 30 plays a role in controlling the units included in the controller 20 and issues instructions to the units of the controller 20. The engine control unit 31 plays a role as a drive unit for controlling or driving the print engine 26, the scanner unit 22, and the like. The input/output control unit 32 inputs into the main control unit 30 a signal and an instruction that are input via the network I/F 28. Moreover, the main control unit 30 controls the input/output control unit 32, and accesses another device via the network I/F 28.

In response to the control of the main control unit 30, the image processing unit 33 generates drawing information based on print information contained in the input print job. The drawing information is information for drawing an image that the print engine 26 being an image forming unit should form in an image forming operation. Moreover, the print information contained in the print job is image information converted into a format that the image forming apparatus 1 can recognize by a printer driver installed in an information processing apparatus such as a PC. The operation display control unit 34 displays information on the display panel 24, or notifies the main control unit 30 of information input via the display panel 24.

If the image forming apparatus 1 operates as a printer, the input/output control unit 32 receives a print job via the network I/F 28 first. The input/output control unit 32 transfers the received print job to the main control unit 30. When receiving the print job, the main control unit 30 controls the image processing unit 33 to generate drawing information based on print information contained in the print job.

When the drawing information is generated by the image processing unit 33, the engine control unit 31 controls the print engine 26 based on the generated drawing information to form an image on a piece of paper conveyed from the paper feed table 25. In other words, the print engine 26 functions as an image forming unit. A document on which the image has been formed by the print engine 26 is ejected into the discharge tray 27.

If the image forming apparatus 1 operates as a scanner, the operation display control unit 34 or the input/output control unit 32 transfers a scan execution signal to the main control unit 30 in response to the user's operation of the display panel 24, or a scan execution instruction input from an external PC or the like via the network I/F 28. The main control unit 30 controls the engine control unit 31 based on the received scan execution signal.

The engine control unit 31 drives the ADF 21 to convey an imaging target document set on the ADF 21 to the scanner unit 22. Moreover, the engine control unit 31 drives the scanner unit 22 to capture the document conveyed from the ADF 21. Moreover, if the document is not set on the ADF 21 but set directly on the scanner unit 22, the scanner unit 22 captures the set document in accordance with the control of the engine control unit 31. In other words, the scanner unit 22 operates as an image capture unit.

In the image capture operation, an image capture device such as a CCD included in the scanner unit 22 optically scans the document, and image capture information generated based on optical information is generated. The engine control unit 31 transfers the image capture information generated by the scanner unit 22 to the image processing unit 33. The image processing unit 33 generates image information based on the image capture information received from the engine control unit 31 in accordance with the control of the main control unit 30. The image information generated by the image processing unit 33 is saved in a recording medium, such as the HDD 40, that is attached to the image forming apparatus 1. In other words, the scanner unit 22, the engine control unit 31, and the image processing unit 33 operate together and function as a document reading unit.

The image information generated by the image processing unit 33 is stored in the HDD 40 or the like as it is at the instruction of the user, or transmitted to an external device via the input/output control unit 32 and the network I/F 28. In other words, the ADF 21 and the engine control unit 31 function as an image input unit.

Moreover, if the image forming apparatus 1 operates as a multifunction peripheral, the image processing unit 33 generates drawing information based on the image capture information received by the engine control unit 31 from the scanner unit 22, or the image information generated by the image processing unit 33. As in the case of the printer operation, the engine control unit 31 drives the print engine 26 based on the drawing information.

Figure 3:
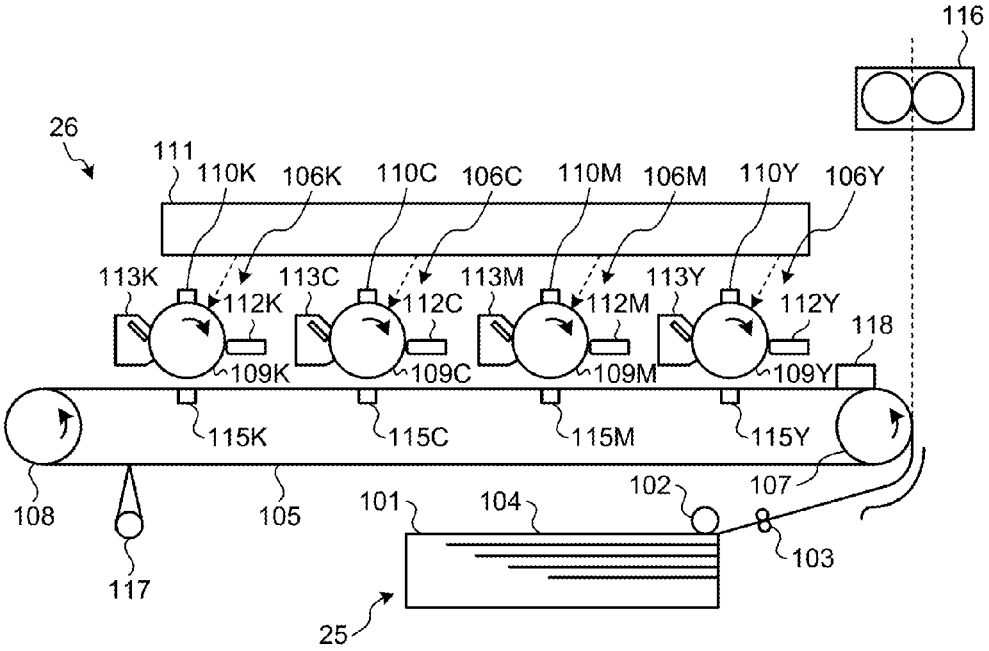
FIG. 3 is a diagram illustrating a configuration of a print engine according to the embodiment of the present invention.

Next, a configuration of the print engine 26 according to the embodiment will be described with reference to FIG. 3. As illustrated in FIG. 3, the print engine 26 according to the embodiment has a configuration where an image forming unit 106 of each color is arranged along a carriage belt 105 being an endless moving unit, and is what is called a tandem type. In other words, a plurality of image forming units (electrophotograph processing units) 106Y, 106M, 106C, and 106K (hereinafter collectively referred to as the image forming unit 106) is arranged along the carriage belt 105 being an intermediate transfer belt where an intermediate transfer image to be transferred onto a sheet (an example of a recording medium) 104 separated and fed by a paper feed roller 102 from a paper feed tray 101 is formed, sequentially from the upstream side of a conveying direction of the carriage belt 105.

Moreover, the sheet 104 fed from the paper feed tray 101 is stopped once by a registration roller 103, and sent out to a transfer position of an image from the carriage belt 105 at the timing of image formation at the image forming unit 106.

The plurality of image forming units 106Y, 106M, 106C, and 106K is different only in the color of a toner image to be formed and has a common internal configuration. The image forming unit 106K, the image forming unit 106M, the image forming unit 106C, and the image forming unit 106Y form a black image, a magenta image, a cyan image, and an yellow image, respectively. In the following description, the image forming unit 106Y is specifically described, but the other image forming units 106M, 106C, and 106K are similar to the image forming unit 106Y. Therefore, the reference numerals of the components of the image forming units 106M, 106C, and 106K are distinguished by M, C, and K and just displayed in the drawing instead of Y assigned to the components of the image forming unit 106Y, and their descriptions will be omitted.

The carriage belt 105 is an endless belt, in other words, an endless-shaped belt that is hung between a drive roller 107 to be rotated and driven and a driven roller 108. The drive roller 107 is rotated and driven by an unillustrated drive motor, and the drive motor, the drive roller 107, and the driven roller 108 function as a drive unit for moving the carriage belt 105 being the endless moving unit.

Upon image formation, the first image forming unit 106Y transfers a black toner image onto the rotated and driven carriage belt 105. The image forming unit 106Y is configured of a photosensitive drum 109Y as a photosensitive element, a charger 110Y arranged on the circumference of the photosensitive drum 109Y, an optical writing device 200, a developing device 112Y, a photosensitive element cleaner (not illustrated), a neutralization device 113Y, and the like. The optical writing device 200 is configured so as to radiate light onto each of photosensitive drums 109Y, 109M, 109C, and 109K (hereinafter collectively referred to as the "photosensitive drum 109").

Upon image formation, the outer surface of the photosensitive drum 109Y is evenly charged by the charger 110Y in the dark and then writing is performed by light from a light source of the optical writing device 200, the light source corresponding to a yellow image, to form an electrostatic latent image. The developing device 112Y visualizes the electrostatic latent image with the yellow toner and accordingly a yellow toner image is formed on the photosensitive drum 109Y.

The toner image is transferred onto the carriage belt 105 by the operation of a transfer device 115Y at a position (transfer position) where the photosensitive drum 109Y and the carriage belt 105 are in contact with each other or are closest to each other. With the transfer, an image with the yellow toner is formed on the carriage belt 105. Unnecessary toner remaining on the outer surface is removed by the photosensitive element cleaner from the photosensitive drum 109Y, which has finished the transfer of the toner image, and then the photosensitive drum 109Y is neutralized by the neutralization device 113Y and waits for the next image formation.

As described above, the yellow toner image transferred by the image forming unit 106Y onto the carriage belt 105 is conveyed to the next image forming unit 106M by the drive of a roller of the carriage belt 105. In the image forming unit 106M, a magenta toner image is formed on the photosensitive drum 109M by a similar process to the image formation process at the image forming unit 106Y, and the toner image is superimposed on and transferred onto the yellow image already formed.

The yellow and magenta toner image transferred onto the carriage belt 105 is conveyed to the further next image forming units 106C and 106K. A cyan toner image formed on the photosensitive drum 109C and a black toner image formed on the photosensitive drum 109K are, by a similar operation, superimposed on and transferred onto the image already transferred. In this manner, a full color intermediate transfer image is formed on the carriage belt 105.

The sheets 104 contained in the paper feed tray 101 are sent out sequentially from the top, and the intermediate transfer image formed on the carriage belt 105 is transferred onto the sheet at a position where the conveying path of the sheet is in contact with the carriage belt 105 or they are closest to each other. Consequently, an image is formed on the sheet 104. The sheet 104 where the image has been formed thereon is further conveyed, and the image is fixed by a fixing device 116. The sheet 104 is ejected to the outside of the image forming apparatus.

Moreover, in such an image forming apparatus 1, a toner image of each color may not overlap toner images of the other colors at a position where they originally need to overlap due to errors in the center distances of the photosensitive drums 109Y, 109M, 109C, and 109K, errors in the degree of parallelization of the photosensitive drums 109Y, 109M, 109C, and 109K, an error in the placement of an LEDA 130 in the optical writing device 111, errors in the timings of writing electrostatic latent images on the photosensitive drums 109Y, 109M, 109C, and 109K, the expansion/contraction of the carriage belt due to a change in temperature in the apparatus or deterioration over time, and the like. Accordingly, misalignment may occur between the colors.

Moreover, an image may be transferred in an area outside an area where the image should have originally been transferred, on a sheet being a transfer target due to similar causes. A skew, a registration deviation in a sub-scanning direction, and the like are mainly known as elements of such misalignment.

A pattern detection sensor 117 is provided to correct such a misalignment. The pattern detection sensor 117 is an optical sensor for reading a pattern for misalignment correction and a pattern for density correction that have been transferred onto the carriage belt 105 by the photosensitive drums 109Y, 109M, 109C, and 109K, and includes a light emitting device for applying the pattern drawn on the surface of the carriage belt 105, and a light receiving device for receiving reflected light from the pattern for correction. As illustrated in FIG. 3, the pattern detection sensor 117 is supported on the same board along a direction orthogonal to the conveying direction of the carriage belt 105 on the downstream side of the photosensitive drums 109Y, 109M, 109C, and 109K.

Moreover, in the image forming apparatus 1, the density of an image transferred on the sheet 104 may change due to changes in the states of the image forming units 106Y, 106M, 106C, and 106K, and a change in the state of the optical writing device 111. In order to correct such changes in density, the pattern for density correction formed in accordance with a predetermined rule is detected, and density corrections are made based on the detection result to correct the drive parameters of the image forming units 106Y, 106M, 106C, and 106K and the drive parameters of the optical writing device 111.

The pattern detection sensor 117 is also used for the detection of the pattern for density correction in addition to the misalignment correction operation by detecting the above-described pattern for misalignment correction. The details of the pattern detection sensor 117 and aspects of misalignment correction and density correction will be described in detail below.

A belt cleaner 118 is provided to remove the toner of the pattern for correction drawn on the carriage belt 105 in such a drawing parameter correction and keep a sheet conveyed by the carriage belt 105 clean. The belt cleaner 118 is a cleaning blade pressed against the carriage belt 105 on the downstream side of the drive roller 107 and on the upstream side of the photosensitive drum 109 as illustrated in FIG. 3, and is a developer removing unit for scraping off the toner attached to the surface of the carriage belt 105.

Figure 4:
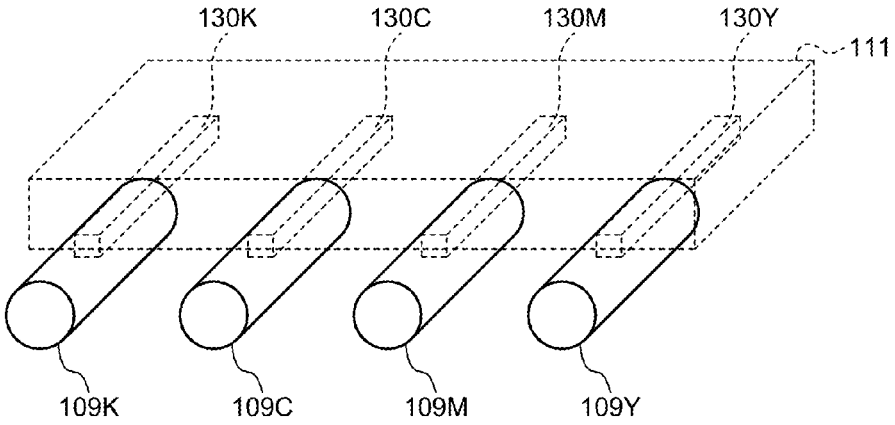
FIG. 4 is a diagram illustrating a configuration of an optical writing device according to the embodiment of the present invention.

Next, the optical writing device 111 according to the embodiment will be described. FIG. 4 is a diagram illustrating an arrangement relationship between the optical writing device 111 according to the embodiment and the photosensitive drum 109. As illustrated in FIG. 4, irradiation light applied respectively to the photosensitive drums 109Y, 109M, 109C, and 109K of the respective colors is irradiated from LEDAs (Light-emitting diode Array) 130Y, 130M, 130C, and 130K (hereinafter collectively referred to as the LEDA 130) being light sources.

The LEDA 130 is configured such that LEDs being light emitting devices are arranged in a main-scanning direction of the photosensitive drum 109. A control unit included in the optical writing device 111 controls the on/off states of the respective LEDs arranged in the main-scanning direction based on the drawing information input from the controller 20 on a main-scanning line by main-scanning line basis and, accordingly, selectively exposes the surface of the photosensitive drum 109 and forms an electrostatic latent image.

Figure 5:
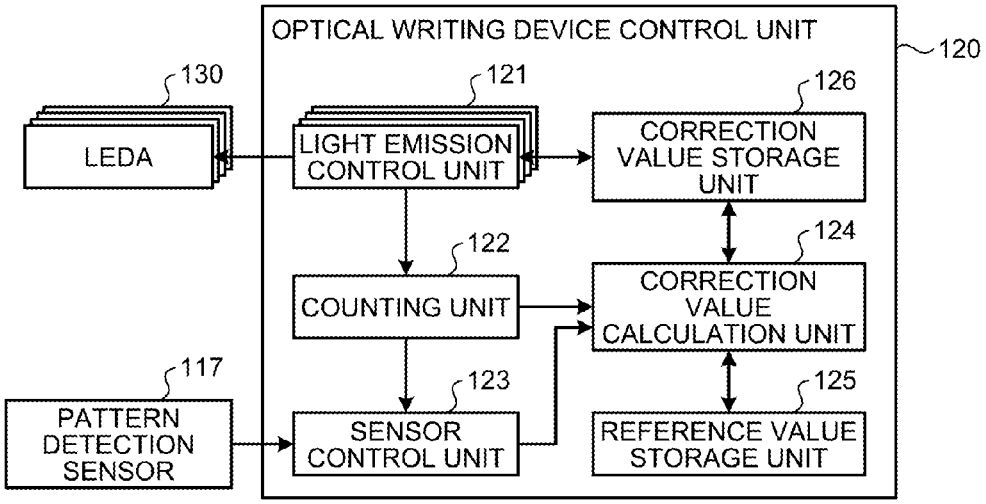
FIG. 5 is a block diagram illustrating configurations of an optical writing control unit and an LEDA according to the embodiment of the present invention.

Next, a control block of the optical writing device 111 according to the embodiment will be described with reference to FIG. 5. FIG. 5 is a diagram illustrating a functional configuration of an optical writing device control unit 120 that controls the optical writing device 111 according to the embodiment, and a connection relationship with the LEDA 130 and the pattern detection sensor 117.

As illustrated in FIG. 5, the optical writing device control unit 120 according to the embodiment includes a light emission control unit 121, a counting unit 122, a sensor control unit 123, a correction value calculation unit 124, a reference value storage unit 125, and a correction value storage unit 126. The optical writing device 111 according to the embodiment includes such information processing mechanisms as have been described in FIG. 1, such as the CPU 10, the RAM 11, the ROM 12, and the HDD 14. Similarly to the controller 20 of the image forming apparatus 1, the optical writing device control unit 120 illustrated in FIG. 5 is configured by loading the control program stored in the ROM 12 or the HDD 14 into the RAM 11 and operating in accordance with the control of the CPU 10.

The light emission control unit 121 is a light source control unit that controls the LEDA 130 based on the image information input from the engine control unit 31 of the controller 20. In other words, the light emission control unit 121 functions also as a pixel information acquisition unit. The light emission control unit 121 causes the LEDA 130 to emit light in a predetermined line cycle to realize optical writing on the photosensitive drum 109.

The line cycle during which the light emission control unit 121 controls the light emission of the LEDA 130 is determined by the output resolution of the image forming apparatus 1. However, if enlargement or reduction is performed in the sub-scanning direction in accordance with a ratio to the conveying speed of a sheet as described above, the light emission control unit 121 adjusts the line cycle to perform enlargement or reduction in the sub-scanning direction.

Moreover, the light emission control unit 121 drives the LEDA 130 based on the drawing information input from the engine control unit 31 and also controls the light emission of the LEDA 130 to draw the pattern for correction in the above-described process of correcting the drawing parameters.

As described in FIG. 4, a plurality of the LEDAs 130 is provided corresponding to the respective colors. Therefore, as illustrated in FIG. 5, a plurality of the light emission control units 121 is also provided to correspond respectively to the plurality of the LEDAs 130. The correction value generated as a consequence of the misalignment correction process among the drawing parameter correction processes is stored as a misalignment correction value in the correction value storage unit 126 illustrated in FIG. 5. The light emission control unit 121 corrects the timing to drive the LEDA 130 based on the misalignment correction value stored in the correction value storage unit 126.

The correction of the timing to drive the LEDA 130 by the light emission control unit 121 is realized, specifically, by delaying, by the line cycle, the timing to drive the LEDA 130 to emit light based on the drawing information input from the engine control unit 31, in other words, shifting a line. For this purpose, the drawing information is input one after another from the engine control unit 31 in accordance with a predetermined cycle. Therefore, it is necessary to hold the input drawing information and delay the timing to read the drawing information in order to shift the line and delay the light emission timing.

Hence, the light emission control unit 121 includes a line memory being a storage medium for holding drawing information input on a main-scanning line by main-scanning line basis, and holds the drawing information input from the engine control unit 31 by storing the drawing information in the line memory.

In the above misalignment correction process, the counting unit 122 starts counting concurrently with the light emission control unit 121 controlling the LEDA 130 to start the exposure of the photosensitive drum 109K. The counting unit 122 acquires a detection signal output by the sensor control unit 123 detecting the pattern for misalignment correction based on an output signal of the pattern detection sensor 117. Moreover, the counting unit 122 inputs into the correction value calculation unit 124 a count value at the timing when acquiring the detection signal. In other words, the counting unit 122 functions as a detection timing acquisition unit that acquires the timing to detect the pattern.

The sensor control unit 123 is a control unit that controls the pattern detection sensor 117 and, as described above, determines that the pattern for misalignment correction formed on the carriage belt 105 has reached the position of the pattern detection sensor 117 based on the output signal of the pattern detection sensor 117 and outputs the detection signal. In other words, the sensor control unit 123 functions as a detection signal acquisition unit that acquires the pattern detection signal of the pattern detection sensor 117.

Moreover, upon density correction with the pattern for density correction, the sensor control unit 123 acquires the signal strength of the output signal of the pattern detection sensor 117 and inputs it in the correction value calculation unit 124. Furthermore, the sensor control unit 123 adjusts the timing to detect the pattern for density correction in accordance with the detection result of the pattern for misalignment correction.

The correction value calculation unit 124 calculates correction values based on reference values for misalignment correction and for density correction that are stored in the reference value storage unit 125 based on the count value acquired from the counting unit 122 and the signal strength of the detection result of the pattern for density correction acquired from the sensor control unit 123. In other words, the correction value calculation unit 124 functions as a reference value acquisition unit and a correction value calculation unit. The reference values used for such calculations are stored in the reference value storage unit 125.

Figure 6:
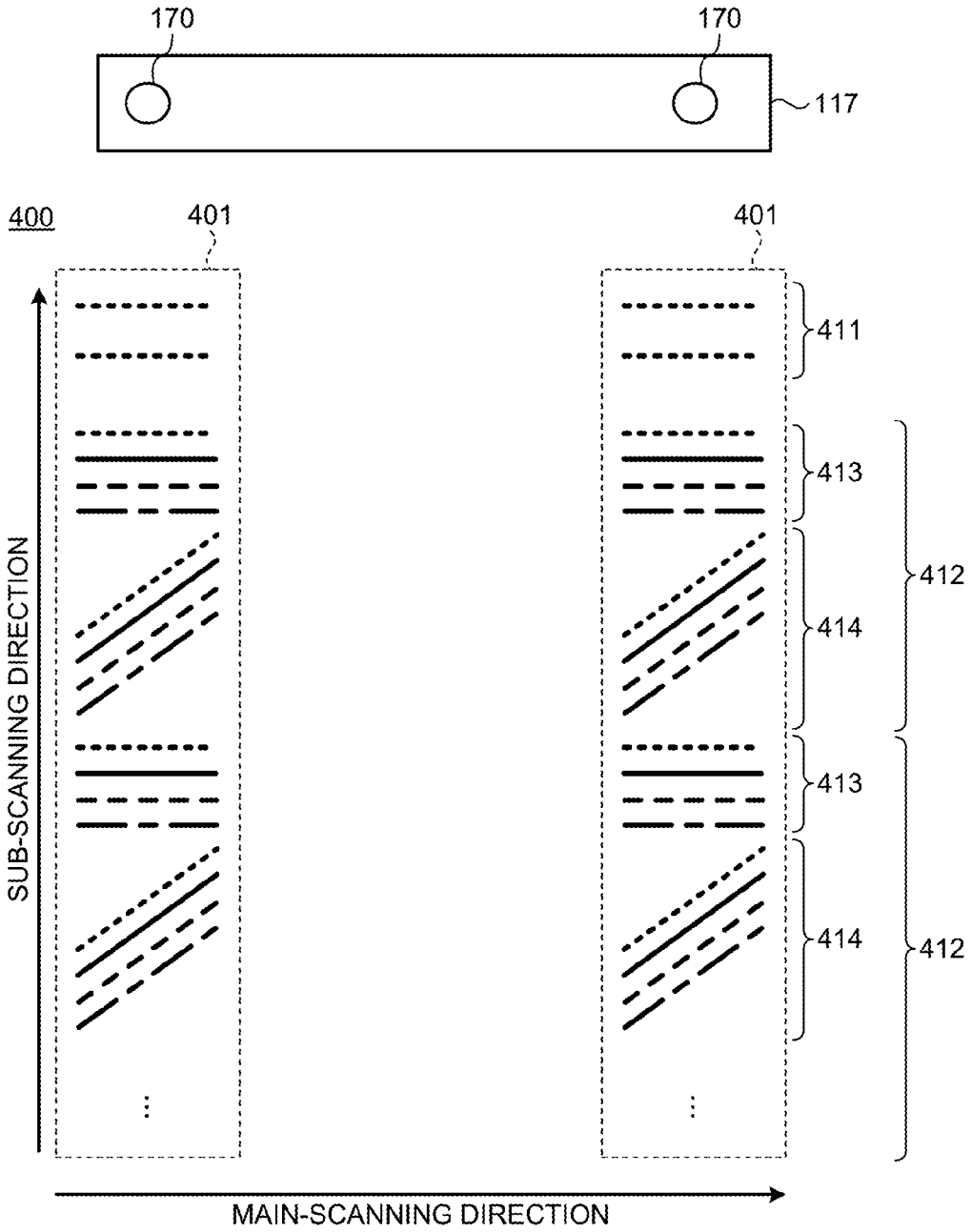
FIG. 6 is a diagram illustrating an example of a first pattern for misalignment correction according to the embodiment of the present invention.

Next, the misalignment correction operation that uses the pattern for misalignment correction will be described. Firstly, descriptions will be given respectively of the two kinds of patterns for correction that can be drawn in the misalignment correction operation according to the embodiment. FIG. 6 is a diagram illustrating a mark that is one kind of the patterns for correction that can be drawn in the misalignment correction operation according to the embodiment, and that is drawn on the carriage belt 105 by the LEDA 130 controlled by the light emission control unit 121 (hereinafter referred to as the "first mark for misalignment correction").

As illustrated in FIG. 6, a first mark for misalignment correction 400 is configured such that a plurality of (two in the embodiment) pattern columns for misalignment correction 401 where various patterns are arranged in the sub-scanning direction is arranged in the main-scanning direction. FIG. 6 illustrates the pattern where the solid line, the dotted line, the broken line, and the dot and dash line are drawn by the photosensitive drums 109K, 109Y, 109C, and 109M, respectively.

As illustrated in FIG. 6, the pattern detection sensor 117 includes a plurality of (two in the embodiment) sensor elements 170 in the main-scanning direction. The pattern columns for misalignment correction 401 are drawn at positions corresponding to the sensor elements 170, respectively. Consequently, it becomes possible for the optical writing control unit 120 to detect the pattern at a plurality of positions in the main-scanning direction and to correct a skew of an image drawn. Moreover, the detection results based on the plurality of sensor elements 170 are averaged to enable an improvement in correction accuracy.

As illustrated in FIG. 6, the pattern column for misalignment correction 401 includes a pattern for whole position correction 411 and a pattern for drum-to-drum spacing correction 412. Moreover, as illustrated in FIG. 6, the pattern for drum-to-drum spacing correction 412 is repeatedly drawn.

As illustrated in FIG. 6, the pattern for whole position correction 411 according to the known technology is lines drawn by the photosensitive drum 109Y, the lines being parallel to the main-scanning direction. The pattern for whole position correction 411 is a pattern drawn to obtain a count value for correcting the deviation of a whole image in the sub-scanning direction, in other words, a transfer position of the image with respect to a sheet. Moreover, the pattern for whole position correction 411 is also used to correct the detection timings when the sensor control unit 123 detects the pattern for drum-to-drum spacing correction 412 and the pattern for density correction to be described below.

In the whole position correction that uses the pattern for whole position correction 411, the optical writing device control unit 120 performs the correction operation of a write start timing based on a read signal of the pattern for whole position correction 411 by pattern detection sensor 117.

The pattern for drum-to-drum spacing correction 412 is a pattern drawn to obtain a count value for correcting the deviation of the drawing timing at the photosensitive drums 109 of the respective colors, in other words, an overlapping position where images of the respective colors overlap with one another. As illustrated in FIG. 6, the pattern for drum-to-drum spacing correction 412 includes a pattern for sub-scanning direction correction 413 and a pattern for main-scanning direction correction 414. As illustrated in FIG. 6, the patterns for drum-to-drum spacing correction 412 are configured by alternating the pattern for sub-scanning direction correction 413 and the pattern for main-scanning direction correction 414, each of which includes a set of patterns of the colors C, M, Y, and K.

The optical writing device control unit 120 corrects misalignments of the photosensitive drums 109K, 109M, 109C, and 109Y in the sub-scanning direction based on a read signal of the pattern for sub-scanning direction correction 413 by the pattern detection sensor 117, and corrects misalignments of the photosensitive drums in the main-scanning direction based on a read signal of the pattern for main-scanning direction correction 414.

Figure 7:
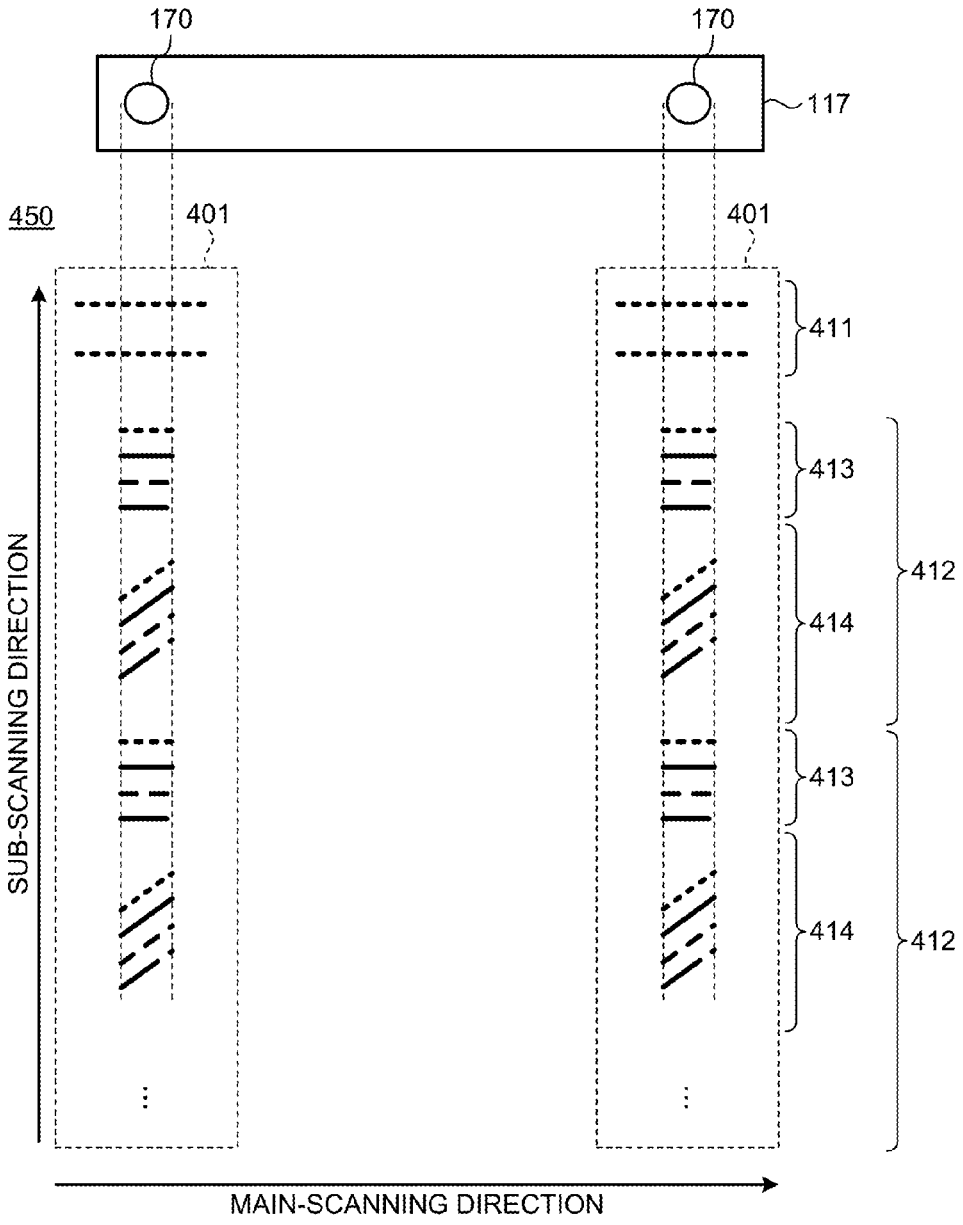
FIG. 7 is a diagram illustrating an example of a second pattern for misalignment correction according to the embodiment of the present invention.

FIG. 7 is a diagram illustrating a mark that is the other kind of the patterns for correction that can be drawn in the misalignment correction operation according to the embodiment, and that is the other kind of mark drawn on the carriage belt 105 by the LEDA 130 controlled by the light emission control unit 121 (hereinafter referred to as the "second mark for misalignment correction").

One of the first mark for misalignment correction 400 and the second mark for misalignment correction 450 is drawn in every misalignment correction operation that is repeatedly executed at predetermined timings and accordingly it is required to make their drawing areas as small as possible and reduce toner consumption. Hence, similarly to the second mark for misalignment correction 450 illustrated in FIG. 7, it is ideal that the width of each pattern in the main-scanning direction be a width corresponding to the detection area of the sensor element 170.

In this manner, in the embodiment, the second mark for misalignment correction 4450 illustrated in FIG. 7 is used as a narrow width pattern, and the first mark for misalignment correction 400 illustrated in FIG. 6 is used as a wide width pattern. However, in reality, a pattern to be drawn can deviate in the main-scanning direction. Hence, if the pattern is drawn in a state where the margin of the detection area of the sensor element 170 in the main-scanning direction is small as illustrated in FIG. 7, when the pattern deviates in the main-scanning direction, the S/N ratio of a sensor output when read by the sensor element 170 may reduce and a detection error may occur.

In this manner, the gist of the embodiment is to enable the drawing of the first mark for misalignment correction 400 and the second mark for misalignment correction 450 and perform the misalignment correction operation by drawing the first mark for misalignment correction 400 upon the misalignment correction operation at the timing when a misalignment is expected to be occurring, and the second mark for misalignment correction 450 upon the misalignment correction operation at another timing, respectively.

At this point, as illustrated in FIGS. 6 and 7, the light emission control unit 121 controls the LEDA 130 and draws the first mark for misalignment correction 400 and the second mark for misalignment correction 450 so as to align the position of the center of each pattern included in the first mark for misalignment correction 400 in the main-scanning direction with the position of the center of each pattern included in the second mark for misalignment correction 450 in the main-scanning direction. Consequently, a state where the misalignment has been corrected with the first mark for misalignment correction 400 brings about a state where each pattern included in the second mark for misalignment correction 450 is detected by the pattern detection sensor 117.

As illustrated in FIG. 7, even in the second mark for misalignment correction 450, the pattern for whole position correction 411 is drawn in a similar width to that of the first mark for misalignment correction 400. This is because the pattern for whole position correction 411 is an important pattern used for the correction of the misalignment of a whole image and also for the correction of a detection timing of another pattern, but is not repeatedly drawn and accordingly a disadvantage obtained when the drawing width is made narrow is large and the advantage of a reduction in toner consumption is small.

Figure 8:
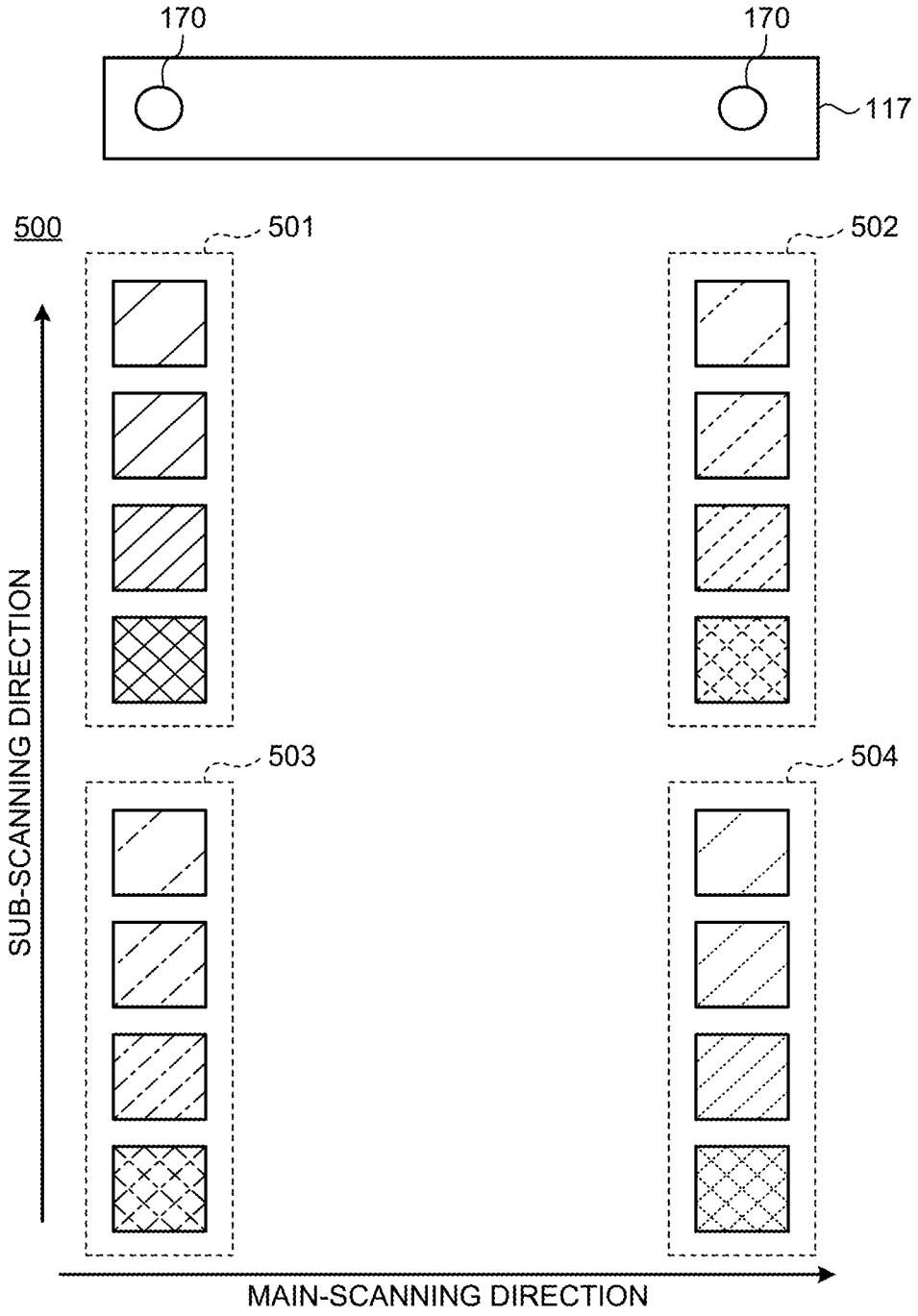
FIG. 8 is a diagram illustrating an example of a pattern for density correction according to the embodiment of the present invention.

Next, the density correction operation according to the embodiment will be described with reference to FIG. 8. FIG. 8 is a diagram illustrating a mark drawn on the carriage belt 105 by the LEDA 130 controlled by the light emission control unit 121 upon the density correction operation according to the embodiment (hereinafter referred to as the mark for density correction). As illustrated in FIG. 7, a mark for density correction 500 according to the embodiment includes a black gradation pattern 501, a cyan gradation pattern 502, a magenta gradation pattern 503, and a yellow gradation pattern 504.

The gradation pattern of each color included in the mark for density correction 500 is configured by four different square patterns having different density in the embodiment, and is configured such that the square patterns are arranged in the sub-scanning direction in the order of density. The gradation patterns of the colors are drawn separated into black and magenta on the left side, and cyan and yellow on the right side. In FIG. 8, the number of hatches on each square pattern indicates the density of the pattern.

In the density correction that uses the mark for density correction 500 illustrated in FIG. 8, the correction value calculation unit 124 acquires from the sensor control unit 123 information indicating density based on the strength of a read signal of each color gradation pattern of the pattern detection sensor 117, and performs the correction operation on developing bias. In other words, a reference value used for density correction among reference values stored in the reference value storage unit 125 is a value to be a reference of the density of each of the four patterns included in each color gradation pattern, the four patterns having different density.

Next, a process of using the first mark for misalignment correction 400 illustrated in FIG. 6 and the second mark for misalignment correction 450 for different purposes will be described with reference to FIG. 9. FIG. 9 is a diagram where various "events" that can be detected in the image processing apparatus 1 according to the embodiment, the "mark for misalignment correction" that should be drawn next time the misalignment correction operation is executed upon the detection of each event, and the "timing" to execute the detection of each event are associated and illustrated.

For example, when the misalignment correction in normal mode is completed, the main control unit 30 of the controller 20 checks the correction result. If the correction was successful, the main control unit 30 controls the optical writing device control unit 120 to draw the first mark for misalignment correction 400 in the misalignment correction operation to be subsequently executed. This is one of the gist of the embodiment. If the normal misalignment correction is successful, the patterns of the colors are expected to be drawn at ideal positions. Accordingly, it is determined that in the subsequent misalignment correction operation, a misalignment can be corrected with the second mark for misalignment correction 450.

On the other hand, if the misalignment correction in normal mode failed, the patterns of the colors are highly likely not drawn at the ideal positions. Therefore, it is difficult to correct a misalignment with the second mark for misalignment correction 450 in the subsequent misalignment correction operation. Accordingly, the main control unit 101 determines that the misalignment correction with the first mark for misalignment correction 400 is necessary.

The known technology also proposes to draw a pattern with a narrow width in the main-scanning direction, corresponding to the narrow width pattern, after a pattern with a wide width in the main-scanning direction, corresponding to the wide width pattern. However, there is room for further consideration regarding an improvement in the efficiency of the control of the device by switching the patterns. In the optical writing device 111 according to the embodiment, the control is performed so as to permit the misalignment correction with the narrow width pattern only when the misalignment correction with the wide width pattern is properly completed.

Moreover, the optical writing device 111 according to the embodiment continues the misalignment correction with the narrow width pattern unless the special condition is satisfied after the misalignment correction with the wide width pattern is properly completed. Consequently, it becomes possible to reduce wasteful toner consumption.

The misalignment correction operation of the image processing apparatus 1 according to the embodiment includes misalignment correction operations called a process mode and a monochrome mode in addition to the normal mode. The misalignment correction in process mode is a misalignment correction to be executed as maintenance if an abnormality occurs in the amount of correction upon initial adjustment in FC (Full Color) priority mode and Bk (Black) priority mode.

A misalignment is corrected in process mode without reflecting the already stored amount of correction and therefore, even if a false amount of correction is stored, a correction value can be obtained without having its influence. The misalignment correction in process mode is executed for the purpose of making the misalignment correction to be subsequently executed in normal mode successful.

Hence, the main control unit 101 determines that the misalignment correction with the first mark for misalignment correction 400 is necessary in the misalignment correction to be subsequently executed irrespective of whether the misalignment correction in process mode is successful or fails.

The misalignment correction in monochrome mode is a misalignment correction to be executed in Bk priority mode and color prohibition mode. In monochrome mode, only the photosensitive drum 109K is used and there is no amount of misalignment between the colors. Hence, in the misalignment correction in monochrome mode, a similar pattern to the pattern for whole position correction 411 is drawn by the photosensitive drum 109K instead of the mark for misalignment correction 400 described in FIG. 6 and only the black gradation pattern 501 illustrated in FIG. 8 is subsequently drawn.

Therefore, even if the misalignment correction in monochrome mode is successful, misalignment corrections are not executed for the photosensitive drums other than the photosensitive drum 109K, and it is not made sure that the transfer positions of toner images are correct. Accordingly, the main control unit 101 determines that the misalignment correction with the first mark for misalignment correction 400 is necessary in the misalignment correction to be subsequently executed.

On the other hand, the main control unit 101 detects whether or not the photosensitive element unit of each color or the intermediate transfer unit is replaced, at the times such as the time of the turning-on of power, the time of returning from a light detection and a sleep mode, and the time of detecting the closing of the device cover. If the replacement is detected, the first mark for misalignment correction 400 is drawn in the misalignment correction operation to be subsequently executed.

This is because attachment mechanisms of the units are respectively provided with mechanical margins in many cases, and if the unit is replaced, a deviation by the mechanical margin may be caused, and the pattern of each color may not be drawn at an ideal position if it is left as it is.

In this manner, the optical writing device control unit 120 according to the embodiment executes the misalignment correction with the second mark for misalignment correction 450 illustrated in FIG. 7 after the calculation of a correction value by the normal misalignment correction operation is properly completed. However, even after the calculation of a correction value by the normal misalignment correction operation is completed, the misalignment correction with the first mark for misalignment correction 400 illustrated in FIG. 6 is executed if the replacement of the unit including the photosensitive element is detected, if the misalignment correction subsequently executed fails, or if the condition where there is expected a high possibility that a misalignment is occurring is satisfied. Consequently, a reduction in the amount of toner consumption related to the drawing of the pattern for correction and the accuracy of device operation are balanced.

Next, a description will be given of a specific aspect when switching the first mark for misalignment correction 400 illustrated in FIG. 6 and the second mark for misalignment correction 450 illustrated in FIG. 7. Images of the first mark for misalignment correction 400 and the second mark for misalignment correction 450 are prepared similarly to the normal image formation output, and the optical writing device control unit 120 is caused to control the LEDA 130 similarly to the normal image formation output. Accordingly, such patterns as are illustrated in FIGS. 6 and 7 can be drawn.

However, in that case, it is necessary to prepare a recording medium for storing the images, which becomes a factor to increase the cost of the optical writing device control unit 120. The storage area relatively has space on the controller 20 side of the image forming apparatus 1. However, it is not appropriate to use the function of the controller 20 side to realize the misalignment correction operation by the optical writing device control unit 120 as an operation independent of the controller 20.

Hence, the optical writing device control unit 120 according to the embodiment specifies as parameters a write start position, a writing area, and the like that are for forming the patterns included in the first mark for misalignment correction 400 and the second mark for misalignment correction 450, which enables the drawing of the first mark for misalignment correction 400 and the second mark for misalignment correction 450. Consequently, there is no need to provide a storage area to store the images of the first mark for misalignment correction 400 and the second mark for misalignment correction 450, and the cost of the optical writing device control unit 120 can be reduced.

Figure 10:
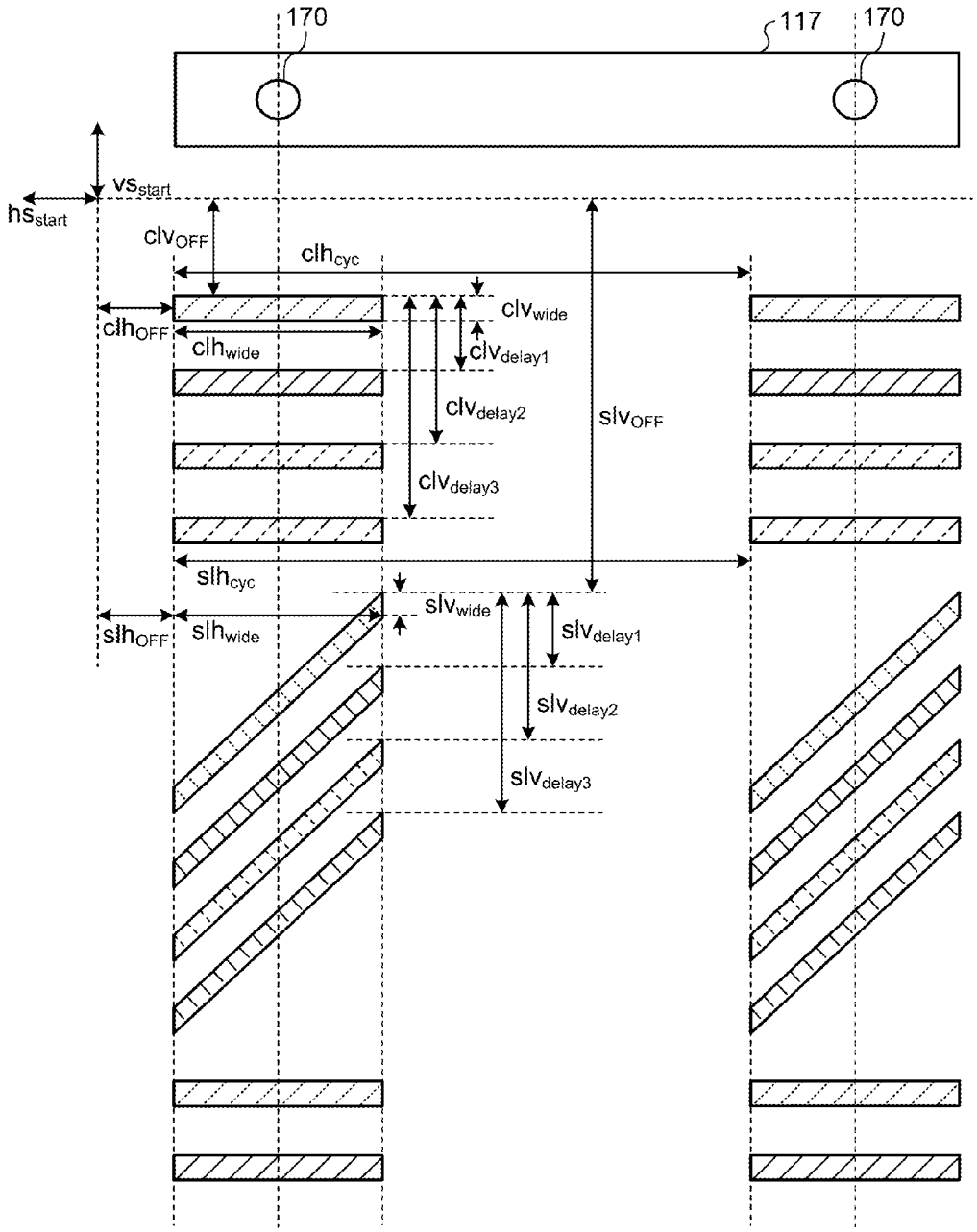
FIG. 10 is a diagram illustrating parameters related to the formation of the mark for misalignment correction according to the embodiment of the present invention.

FIG. 10 is a diagram illustrating parameters for drawing the pattern for drum-to-drum spacing correction 412 of the first mark for misalignment correction 400 illustrated in FIG. 6. As illustrated in FIG. 10, a drawing start point of the pattern for drum-to-drum spacing correction 412 is decided by a main-scanning start position hs (horizontal scanning)$_{start}$, and a sub-scanning start position vs (virtical scanning)$_{start}$.

As illustrated in FIG. 10, parameters of a horizontal line pattern main offset clh (cross line horizontal)$_{OFF}$, a horizontal line pattern main-scanning width $clh_{wide}$, a horizontal line pattern main-scanning cycle $clh_{cyc}$, a horizontal line pattern sub offset clv (cross line virtical)$_{OFF}$, a horizontal line pattern sub-scanning width clv (cross line vertical)$_{OFF}$, a horizontal line pattern sub-scanning width $clv_{wide}$, and a horizontal line pattern sub-scanning delay $clv_{delay}$ are used to draw the pattern for sub-scanning direction correction 413.

Moreover, as illustrated in FIG. 10, parameters of a slant line pattern main offset slh (slant line horizontal)$_{OFF}$, a slant line pattern main-scanning width $slh_{wide}$, a slant line pattern main-scanning cycle $slh_{cyc}$, a slant line pattern sub offset slh (slant line virtical)$_{OFF}$, a slant line pattern sub-scanning width $slv_{wide}$, a slant line pattern sub-scanning width $slv_{wide}$, and a slant line pattern sub-scanning delay $slv_{delay}$ are used to draw the pattern for main-scanning direction correction 414.

Figure 11:
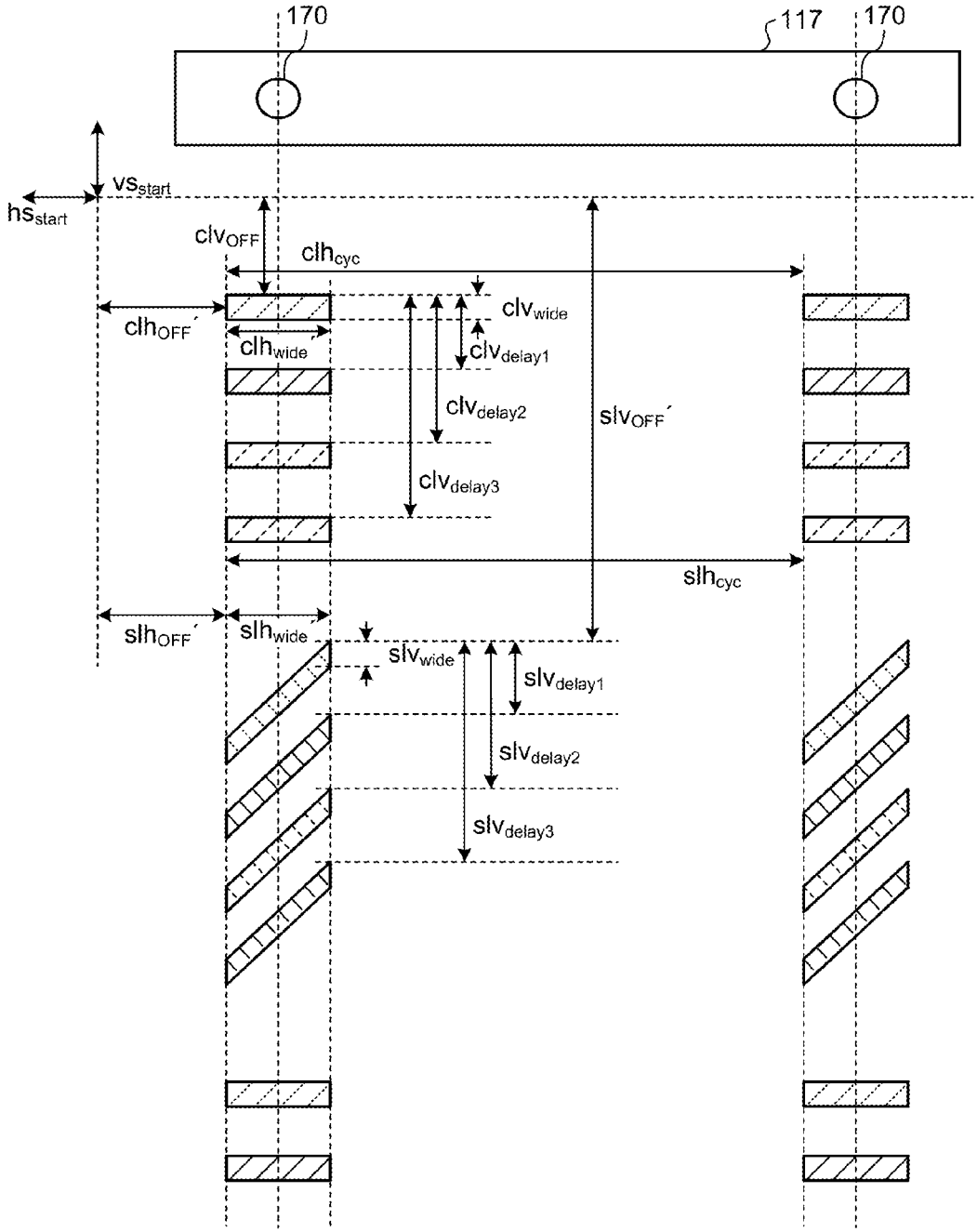
FIG. 11 is a diagram illustrating the parameters related to the formation of the mark for misalignment correction according to the embodiment of the present invention.

Moreover, FIG. 11 is a diagram illustrating parameters for drawing the pattern for drum-to-drum spacing correction 412 of the second mark for misalignment correction 450 illustrated in FIG. 7. As illustrated in FIG. 11, also in the second mark for misalignment correction 450, the main-scanning start position $hs_{start}$ and the sub-scanning start position $vs_{start}$ are used similarly.

As illustrated in FIG. 11, a horizontal line pattern main offset $clh_{OFF}'$ and a horizontal line pattern main-scanning width $clh_{wide}'$ are used instead of the horizontal line pattern main offset $clh_{OFF}$ and the horizontal line pattern main-scanning width $clh_{wide}$ to draw the pattern for sub-scanning direction correction 413 in the second mark for misalignment correction 450.

Moreover, as illustrated in FIG. 11, a slant line pattern main offset $slh_{OFF}'$, a slant line pattern main-scanning width $slh_{wide}'$ and a slant line pattern sub offset $slv_{OFF}'$ are used instead of the slant line pattern main offset $slh_{OFF}'$, the slant line pattern main-scanning width $slh_{wide}'$, and the slant line pattern sub offset $slv_{OFF}$ to draw the pattern for main-scanning direction correction 414 in the second mark for misalignment correction 450.

Upon the drawing of the second mark for misalignment correction 450 illustrated in FIG. 11, arbitrary values are specified for the horizontal line pattern main-scanning width $clh_{wide}'$ and the slant line pattern main-scanning width $slh_{wide}'$. The horizontal line pattern main offset $clh_{OFF}'$, the slant line pattern main offset $slh_{OFF}'$, and the slant line pattern sub offset $slv_{OFF}'$ are respectively determined by the following equations (1) to (3).

$$clh'_{OFF} = Lh_{sens} - \frac{clh'_{wide}}{2} \quad (1)$$

$$slh'_{OFF} = Lh_{sens} - \frac{slh'_{wide}}{2} \quad (2)$$

$$slv'_{OFF} = slv_{OFF} + \left(\frac{slv_{wide} - \alpha slh'_{wide}}{2}\right) \quad (3)$$

"$Lh_{sens}$" illustrated in the equations (1) and (2) is an interval between the drawing start point in the main-scanning direction and the central position of the sensor element 170 in the main-scanning direction as illustrated in FIG. 10. Moreover, "α" illustrated in the equation (3) is a coefficient to convert the interval in the main-scanning direction into an interval in the sub-scanning direction according to the slope of the pattern for main-scanning direction correction 414. In the embodiment, the slope of the pattern for main-scanning direction correction 414 is 45°, and therefore α=1.

In this manner, upon the drawing of the first mark for misalignment correction 400 and the second mark for misalignment correction 450 illustrated in FIGS. 6 and 7, the optical writing device 111 according to the embodiment does not cause the light emission control unit 121 to drive the LEDA 130 to emit light with the images of the marks. However, such parameters indicating the sizes of the units as are illustrated in FIGS. 10 and 11 are prepared to cause the light emission control unit 121 to drive the LEDA 130 to emit light in accordance with the respective parameters. Accordingly, there is no need to prepare a storage area to store images corresponding to the first mark for misalignment correction 400 and the second mark for misalignment correction 450 and it becomes possible to avoid an increase in the cost of the optical writing device control unit 120.

As described above, the optical writing device 111 mounted on the image forming apparatus 1 according to the embodiment detects a predetermined event of the apparatus at a predetermined timing as described in FIG. 9 and accordingly detects that a misalignment is large with the correction value stored in the correction value storage unit 126 at the timing.

If it is not detected that the misalignment is large, the second mark for misalignment correction 450 illustrated in FIG. 7 is drawn to execute the misalignment correction. Accordingly, the amount of toner consumption is reduced. Moreover, if it is detected that the misalignment is large, the first mark for misalignment correction 400 illustrated in FIG. 6 is drawn to execute the misalignment correction with a pattern that ensures the success of the misalignment correction. Such a process makes it possible to balance a reduction in the amount of toner consumption related to the drawing of the pattern for correction and the accuracy of device operation.

As described in FIG. 9, if the normal misalignment correction fails, the main control unit 101 determines that the misalignment correction with the first mark for misalignment correction 400 is necessary. A description will be given here of a factor to determine that the misalignment correction failed.

Figure 12A:
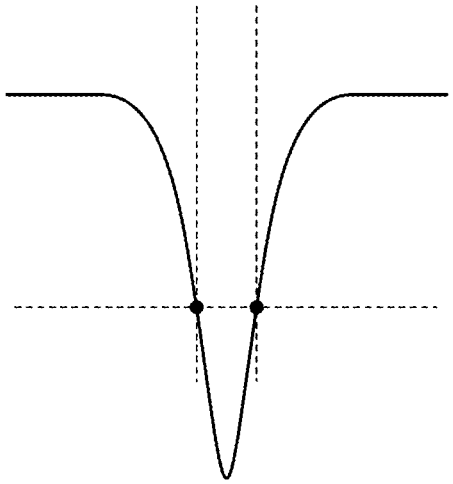
FIGS. 12A to 12C are diagrams illustrating signal detection aspects according to the embodiment of the present invention.
Figure 12B:
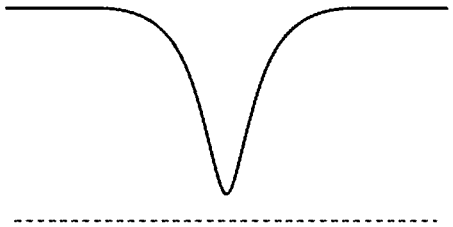
Figure 12C:
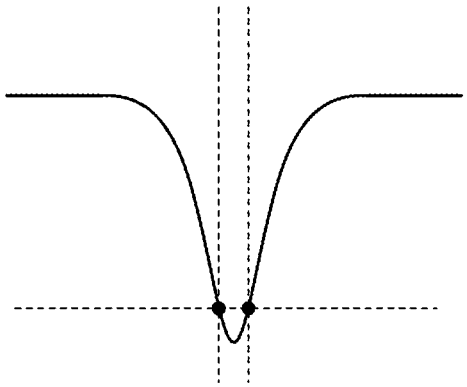

FIGS. 12A to 12C are diagrams schematically illustrating a mechanism of pattern detection by the detection signal of the pattern detection sensor 117 in the misalignment correction operation. FIG. 12A is a diagram illustrating a case where the pattern has been detected normally. As illustrated in FIGS. 12A to 12C, upon pattern detection, the sensor control unit 123 detects that the detection signal of the pattern detection sensor 117 has intersected with a predetermined threshold level.

In the case of FIG. 12A, the pattern has been detected normally. Accordingly, upon the detection of one pattern, the sensor control unit 123 detects two intersections with the threshold level with a predetermined interval. The detection timing of the pattern is decided based on a detection timing period between the timings of two intersections with the threshold level, and the like.

FIG. 12B is a diagram illustrating an aspect of a case where the pattern has not been detected normally, and an example of a case where the signal strength of the detection signal was too weak to reach the threshold level. In this case, the signal does not intersect with the threshold level and accordingly the sensor control unit 123 detects nothing. In other words, the optical writing device control unit 120 can determine the failure of the misalignment correction since the signal that should have been detected was not detected.

FIG. 12C is a diagram illustrating another aspect of the case where the pattern has not been detected normally, and a case where the signal strength of the detection signal has reached the threshold level but the intensity of vibration is weak and therefore a period between timings of the detection of two intersections with the threshold level is short. In this case, the optical writing device control unit 120 can determine the failure of the misalignment correction since the period between the two detection timings is shorter than a predetermined period.

In addition, as a method where the optical writing device control unit 120 determines the failure of the misalignment correction, a determination based on a correction value calculated by the correction value calculation unit 124 is possible. In other words, the optical writing device control unit 120 can determine the failure of the misalignment correction if the calculated correction value exceeds a predetermined specified allowable range.

According to the embodiment, it becomes possible to balance a reduction in the amount of toner consumption related to the drawing of the pattern for correction with the accuracy of the operation of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing control device configured to control a light source that exposes a photosensitive element and forms an electrostatic latent image on the photosensitive element, the optical writing control device comprising:

a light emission control unit configured to, control light emission of the light source based on information on pixels constituting an image to be formed and output, and expose the photosensitive element;

a detection signal acquisition unit configured to acquire a detection signal of a sensor configured to detect the image on a conveying path on which the image obtained by developing the electrostatic latent image formed on the photosensitive element is transferred and conveyed; and a correction value calculation unit configured to calculate a correction value for correcting a transfer position of the image based on the detection signal when the sensor detects a pattern for the correcting of the transfer position, wherein the light emission control unit is configured to, draw at least one of two patterns for the correcting of the transfer position, the two patterns including a narrow width pattern where a width of the pattern in a main-scanning direction corresponds to a width of a detection area of the sensor in the main-scanning direction, and a wide width pattern having a wider width than the width of the narrow width pattern in the main-scanning direction, and control the light emission of the light source based on the narrow width pattern until the detection signal acquisition unit fails to acquire the detection signal of the sensor based on the drawn narrow width pattern.

2. The optical writing control device according to claim 1, wherein the light emission control unit is configured to control the light emission of the light source based on the wide width pattern prior to switching to controlling the light emission of the light source based on the narrow width pattern, and the light emission control unit is configured to maintain controlling the light emission of the light source based on the wide width pattern if the detection signal acquisition unit fails to acquire a detection signal of the sensor based on the drawn wide width pattern.

3. The optical writing control device according to claim 2, wherein the light emission control unit is configured to maintain controlling the light emission of the light source based on the wide width pattern upon detection of replacement of a unit including the photosensitive element.

4. The optical writing control device according to claim 3, wherein the light emission control unit is configured to maintain controlling the light emission of the light source based on the wide width pattern, when the replacement is detected at at least one of a time corresponding to turning-on a power to a device, at time corresponding to the device returning from a power-saving state, and a time corresponding to one of opening or closing of a cover included in a housing of the device.

5. The optical writing control device according to claim 2, wherein the light emission control unit is configured to maintain controlling the light emission of the light source based on the wide width pattern upon detection of replacement of a unit including a component for transferring the developer image.

6. The optical writing control device according to claim 5, wherein the light emission control unit is configured to maintain controlling the light emission of the light source based on the wide width pattern, when the replacement is detected at at least one of a time corresponding to turning-on a power to a device, at time corresponding to the device returning from a power-saving state, and a time corresponding to one of opening or closing of a cover included in a housing of the device.

7. The optical writing control device according to claim 1, wherein the light emission control unit is configured to control the light emission of the light source, in a manner where an electrostatic latent image corresponding to the wide width pattern is formed based on information on parameters indicating drawing positions of the wide width pattern, and in a manner where an electrostatic latent images corresponding to the narrow width pattern is formed based on information on parameters indicating drawing positions of the narrow width pattern.

8. The optical writing control device according to claim 1, wherein the light emission control unit is configured to switch from controlling the light emission of the light source based on the narrow width pattern to controlling the light emission of the light source based on the wide width pattern, when the detection signal acquisition unit fails to acquire the detection signal of the sensor based on the drawn narrow width pattern.

9. An image forming apparatus comprising:

an optical writing control device configured to control a light source that exposes a photosensitive element and forms an electrostatic latent image on the photosensitive element, wherein the optical writing control device includes, a light emission control unit configured to, control light emission of the light source based on information on pixels constituting an image to be formed and output, and expose the photosensitive element;

a detection signal acquisition unit configured to acquire a detection signal of a sensor configured to detect the image on a conveying path on which the image obtained by developing the electrostatic latent image formed on the photosensitive element is transferred and conveyed; and a correction value calculation unit configured to calculate a correction value for correcting a transfer position of the image based on the detection signal when the sensor detects a pattern for the correcting of the transfer position, and the light emission control unit is configured to, draw at least one of two patterns for the correcting of the transfer position, the two patterns including a narrow width pattern where a width of the pattern in a main-scanning direction corresponds to a width of a detection area of the sensor in the main-scanning direction, and a wide width pattern having a wider width than the width of the narrow width pattern in the main-scanning direction, and control the light emission of the light source based on the narrow width pattern until the detection signal acquisition unit fails to acquire the detection signal of the sensor based on the drawn narrow width pattern.

10. The image forming apparatus according to claim 9, wherein the light emission control unit is configured to switch from controlling the light emission of the light source based on the narrow width pattern to controlling the light emission of the light source based on the wide width pattern, when the detection signal acquisition unit fails to acquire the detection signal of the sensor based on the drawn narrow width pattern.

11. A method of controlling an optical writing device that controls a light source that exposes a photosensitive element and forms an electrostatic latent image on the photosensitive element, the method comprising:

controlling light emission of the light source based on information on pixels constituting an image to be formed and output;

exposing the photosensitive element;

acquiring a detection signal of a sensor that detects the image on a conveying path on which the image obtained by developing the electrostatic latent image formed on the photosensitive element is transferred and conveyed;

calculating a correction value for correcting a transfer position of the image based on the detection signal when the sensor detects a pattern for the correcting of the transfer position;

drawing at least one of two patterns for the correcting of the transfer position, the two patterns including a narrow width pattern where a width of the pattern in a main-scanning direction corresponds to a width of a detection area of the sensor in the main-scanning direction, and a wide width pattern having a wider width than the width of the narrow width pattern in the main-scanning direction; and controlling the light emission of the light source based on the narrow width pattern until the acquiring fails to acquire the detection signal of the sensor based on the drawn narrow width pattern.

12. The method according to claim 11, further comprising:

switching from controlling the light emission of the light source based on the narrow width pattern to controlling the light emission of the light source based on the wide width pattern, when the acquiring fails to acquire the detection signal of the sensor based on the drawn narrow width pattern.

* * * * *